US006202437B1

(12) United States Patent
Yun

(10) Patent No.: US 6,202,437 B1
(45) Date of Patent: Mar. 20, 2001

(54) SUCTION ACCUMULATOR PRE-CHARGED WITH OIL

(75) Inventor: Kyung Woo Yun, Kwangju (KR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/314,403

(22) Filed: May 19, 1999

(51) Int. Cl.[7] ..... F25B 53/00
(52) U.S. Cl. ..... 62/503; 62/471
(58) Field of Search ..... 62/503, 470, 471

(56) References Cited

U.S. PATENT DOCUMENTS 1,978,463 * 10/1934 Kettering ..... 62/115
4,429,544 * 2/1984 McCarty ..... 62/84
5,347,817 * 9/1994 Kim ..... 62/471
5,507,159 * 4/1996 Cooksey ..... 62/503
5,850,743 * 12/1998 Dreiman et al. ..... 62/503
5,868,001 2/1999 Shoulders .

* cited by examiner

*Primary Examiner*—Corrine McDermott
*Assistant Examiner*—Marc Norman

(57) ABSTRACT

The suction accumulator is pre-charged with oil that is contained ordinarily in accumulator body. This pre-charged oil amount is in addition to the amount of oil normally charged into compressor oil sump, and makes the total amount of oil charge greater. This increased oil helps improve compressor lubrication under boundary lubrication conditions due to liquid refrigerant. Without increasing the amount of oil in the oil sump of the compressor, the quality of the oil is improved with an accumulator with pre-charged oil. That is, additional oil is charged into the accumulator, and the oil return orifice is so located in elevation that a specified volume is contained below the orifice. The volume of the accumulator is increased by providing a side discharge from the accumulator to the suction inlet of the compressor and by extending the accumulator below the suction inlet. In reality though, the volume does not necessarily contain pure oil because oil almost always contains some refrigerant.

6 Claims, 2 Drawing Sheets

SUCTION ACCUMULATOR PRE-CHARGED WITH OIL

BACKGROUND OF THE INVENTION

In an inactive air conditioning or refrigeration system, refrigerant tends to condense and collect at low and/or cool locations in the system. Because of the affinity between refrigerants and the lubricants used therewith, refrigerant is normally present in the oil. If liquid refrigerant and/or oil is drawn into the compressor, a condition known as slugging occurs. Because liquids are essentially incompressible, the increased volume required to be discharged due to the incompressibility can cause damage to the compressor. This damage is due to the pressure build up caused by the higher than design volumetric flow due to the incompressibility of the liquid refrigerant and/or oil.

To avoid liquid slugging, a suction accumulator is commonly located immediately upstream of the suction of the compressor of an air conditioning or refrigeration system. The accumulator is normally limited in size for reasons of cost, available space, or as a matter of design choice. These limitations allow only a certain maximum oil/refrigerant ratio where the amount of oil is determined by the size of compressor oil sump and the amount of refrigerant is set by the charge amount which optimizes system performance. An accumulator serves two major purposes in that it acts as a sump for storing liquid refrigerant and any associated oil as well as serving to meter the feeding of the liquid refrigerant/oil back to the compressor. The suction feed pipe extends into the accumulator to a height above the design level of liquid refrigerant/oil and has a metered opening in fluid communication with the interior of the accumulator in a lower portion of the accumulator corresponding to a minimum residual liquid refrigerant/oil level.

When the compressor is started, the liquid which has entered and collected in the suction accumulator will tend to be drawn into the compressor with the liquid refrigerant tending to evaporate due to the reduced pressure associated with the suction stroke of the compressor. Normally, the liquid collecting in the accumulator in an inactive air conditioner will, primarily, be refrigerant and components relying on the normal oil content for lubrication may, instead, have lubricant washed away by refrigerant upon start up. Other than the initial liquid in the suction accumulator, gaseous and/or liquid refrigerant will be drawn from the evaporator into the accumulator and via the suction feed pipe into the compressor with the flow entering the suction feed pipe at a location in the upper portion of the accumulator. Additionally, any liquid in the accumulator at a level such as to be in fluid communication with the metered opening will be drawn into the suction flow on a metered basis with the liquid refrigerant tending to be evaporated in being aspirated into the suction flow. The metered flow into the suction feed pipe will continue until the liquid level is brought down to the level of the metered opening.

SUMMARY OF THE INVENTION

The present invention provides an accumulator with an increased volume and a pre-charge of oil which is retained in the accumulator as an oil/refrigerant mixture due to the affinity between refrigerants and lubricants. Since there is a residual charge of oil in the accumulator, when liquid refrigerant enters the accumulator, it mixes first with the oil in the accumulator, improving the quality of the oil/refrigerant mixture, before entering the compression chamber of the compressor. The oil viscosity, a determinant for lubrication, is determined by the proportion of refrigerant dissolved in the oil/refrigerant mixture and the pressure the mixture is exposed to. Thus, in order to maintain the minimum viscosity required for certain bearing designs derived from the minimum film thickness requirement, the oil/refrigerant ratio needs to be kept at a reasonably high level. To facilitate oil separation and its returning to the accumulator, the inlet to the suction feed pipe is preferably located at a point above the baffle screen/ports in the baffle through the use of a baffle which coacts therewith to require two 180° turns in the flow entering the accumulator before it reaches the inlet of the suction feed pipe thereby tending to separate out any entrained liquid due to centrifugal action.

Because it is necessary for the accumulator to store liquid refrigerant in the volume above the metering hole both when the system is active and when it is inactive, the volume of oil added according to the teachings of the present invention cannot reduce the available storage volume above the metering hole for liquid refrigerant. The present invention permits a greater residual liquid storage by extending the accumulator below the metering hole in the suction feed pipe and by providing a side discharge into the suction of the compressor such that the accumulator extends below the suction inlet of the compressor. By initially storing oil in the accumulator in the increased volume below the metering hole, there is a residual oil sump such that it is possible to dilute pure liquid refrigerant with oil before the mixture is drawn into the compressor though the metering port in the suction feed pipe or standpipe.

It is an object of this invention to improve the oil/refrigerant ratio in a an air conditioning or refrigeration system.

It is a further object of this invention to provide a circuitous gas flow path in an accumulator.

It is an additional object of this invention to provide a suction accumulator providing additional storage for oil. These objects, and others as will become apparent hereinafter, are accomplished by the present invention.

Basically, the volume of the suction accumulator is increased by providing a side discharge into the suction of a compressor and extending the accumulator below the suction inlet of the compressor so as to provide an increased volume. The suction accumulator is pre-charged with oil that is contained ordinarily in the accumulator body. This pre-charged oil amount is in addition to the amount of oil normally charged into the compressor oil sump, and makes the total amount of oil charge greater. This increased oil helps improve compressor lubrication under boundary lubrication conditions caused by liquid refrigerant. Without increasing the amount of oil in the oil sump of the compressor, the quality of the oil is improved with an accumulator with pre-charged oil. That is, additional oil is charged into the accumulator, and the oil return orifice is so located in elevation that a specified volume is contained below the orifice. In reality though, the volume does not necessarily contain pure oil because oil normally contains a certain amount of refrigerant.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
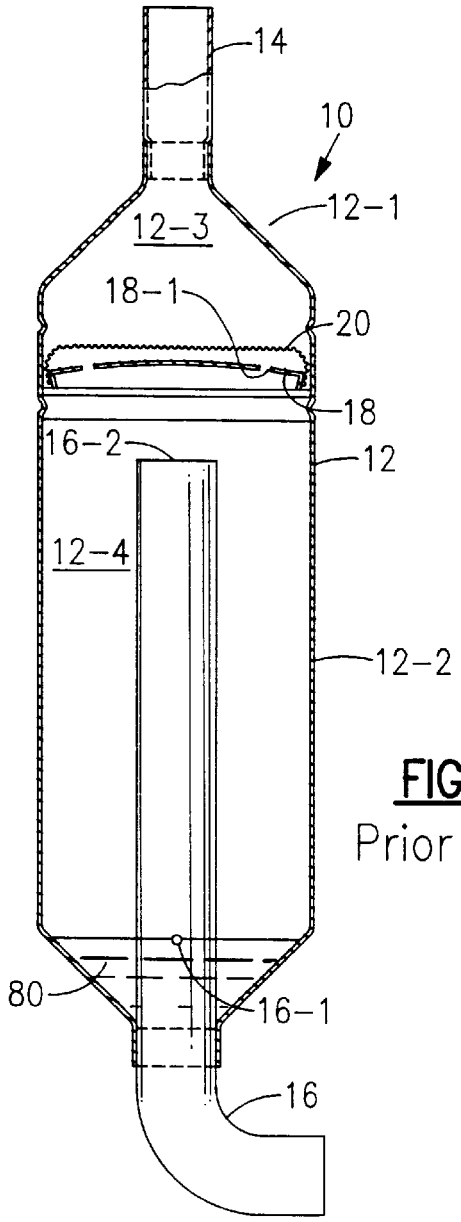
FIG.1 Prior Art
FIG. 1 is a partially sectioned view of a PRIOR ART accumulator.
Figure 3:
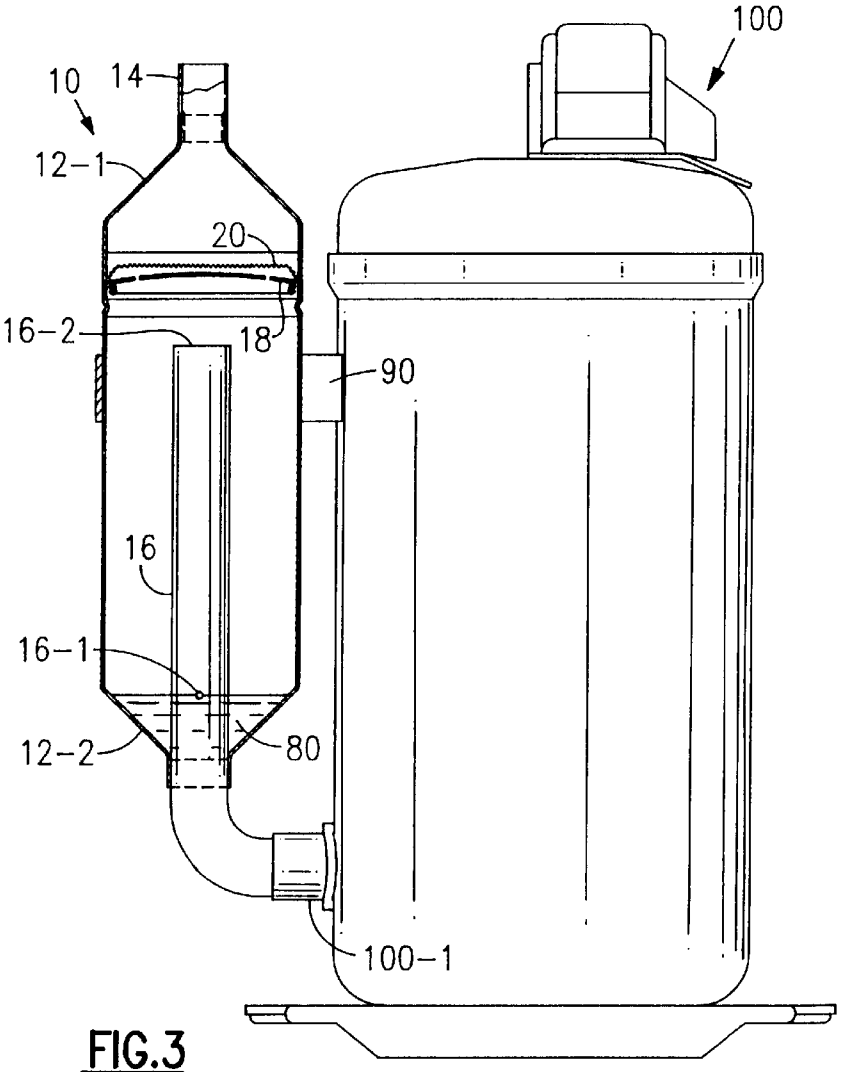
FIG.3 Prior Art
FIG. 3 is a partially sectioned view of a PRIOR ART accumulator and a hermetic compressor.

In FIGS. 1 and 3 the numeral 10 generally designates a PRIOR ART accumulator which, in FIG. 3, is shown secured to hermetic compressor 100 by circumferential band 90. Accumulator 10 includes a upper housing member 12-1 and a lower housing member 12-2 which are suitably sealed together, as by welding, to form housing 12. Inlet pipe 14 is sealingly secured to upper housing member 12-1 and would be fluidly connected to an evaporator (not illustrated) through an expansion device (not illustrated) in an air conditioning or refrigeration system. Suction feed pipe 16 is sealingly received in the bottom of lower housing 12-2 and extends into the interior of housing 12 a distance roughly corresponding to 60% of the axial length of housing 12. A metering port 16-1 is formed in suction feed pipe 16 at a location near the bottom of the lower portion of the interior of housing 12 and is of a diameter on the order of 0.04 inches (1.0 mm). The interior of housing 12 is divided into an upper portion 12-3 and a lower portion 12-4 by baffle 18. Baffle 18 is suitably secured in housing 12 as by welding or an interference fit and has a plurality of holes 18-1 which provide fluid communication between upper portion 12-3 and lower portion 12-4 of the interior of casing 12. Holes 18-1 will typically be four to twelve in number and 0.2 to 0.6 inches in diameter with a total open space of 30 to 40%. Baffle 18 is overlain by screen 20 which is suitably secured in upper portion 12-3 and serves to filter the flow entering accumulator 10.

In operation, the running of high side hermetic compressor 100, which may be a reciprocating or rolling piston rotary compressor, tends to draw refrigerant from the evaporator of a refrigeration system (not illustrated) into accumulator 10 with the flow serially passing through inlet pipe 14 into upper portion 12-3 of housing 12, through screen 20 and holes 18-1 into lower portion 12-4 of housing 12. As is clear from the drawings, flow passing through holes 18-1 need only be diverted less than 90° to pass into the open end, 16-2, of suction feed pipe 16. Flow through suction feed pipe 16 passes through suction inlet 100-1 into compressor 100 and is compressed. It will be noted that accumulator 10 is located above suction inlet 100-1. If there is any liquid refrigerant and/or oil 80 in lower portion 12-4 at a level up to or above metering port 16-1, the flow through suction feed pipe 16 aspirates the liquid 80 into the flow being supplied to suction inlet 100-1 of compressor 100. Oil or on oil/refrigerant mixture 80 which passes through metering port 16-1 tends to expand and become a gas due to the lowering of pressure in the suction flow.

Figure 2:
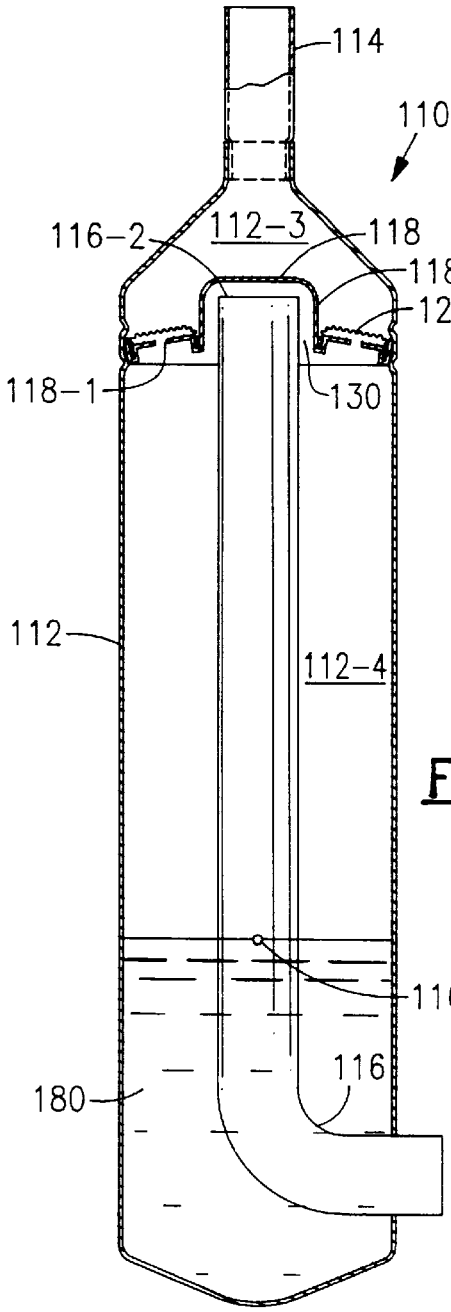
FIG. 2 is a partially sectioned view of an accumulator made according to the teachings of the present invention.
Figure 4:
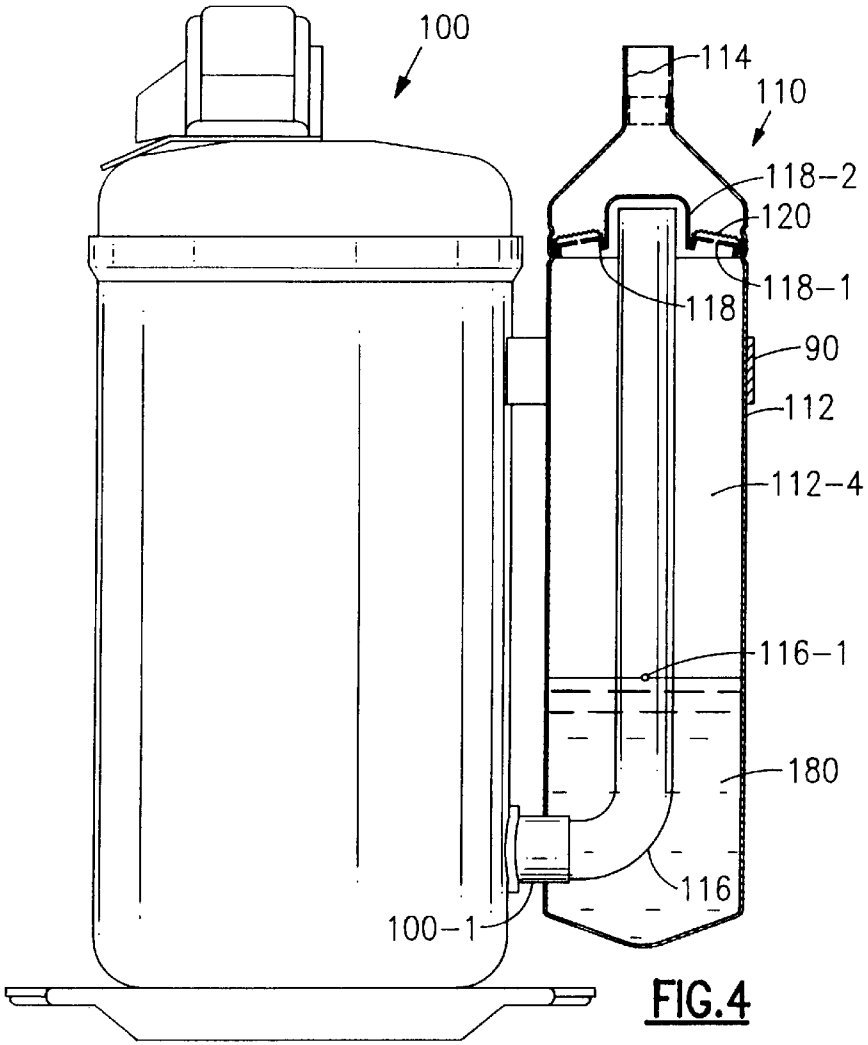
FIG. 4 is a partially sectioned view of an accumulator made according to the teachings of the present invention and a hermetic compressor.

Referring now to FIGS. 2 and 4, structure of accumulator 110 has been numbered one hundred higher than the corresponding structure of FIGS. 1 and 3. Accumulator 110 differs from accumulator 10 in that suction feed pipe 116 is higher/longer and extends from the side of housing 112, baffle 118 is modified, screen 120 is modified, upper portion 112-3 is smaller and lower portion 112-4 is larger and extends well below suction feed pipe 116 and suction inlet 100-1. Baffle 118 has an axially extending central portion 118-2 having a closed end which defines a bore for receiving open end 116-2 and a portion of suction feed pipe 116 in a spaced relationship.

Comparing accumulators 10 and 110 which are presented side by side in FIGS. 1 and 2 and in FIGS. 3 and 4, respectively, it will be noted that suction feed pipe 116 is longer than suction feed pipe 16 and that open end 116-2 of suction feed pipe 116 is above holes 118-1 whereas open end 16-2 is beneath holes 18-1 also, feed pipe 116 extends from the side of housing 112 rather than the bottom. Upper portion 112-3 is smaller than upper portion 12-3 and lower portion 112-4 is larger than lower portion 12-4. Accumulator 110 has a greater volume than accumulator 10 and the portion of lower portion 112-4 below metering port 116-1 is much greater than the portion of lower portion 12-4 below metering port 16-1 such that the residual oil/refrigerant 180 is on the order of 30–35% of the combined volume of upper portion 112-3 and lower portion 112-4 whereas the residual oil/refrigerant 80 is on the order of 3–8% of the volume of lower portion 12-4. Open end 116-2 is separated from holes 118-1 by an annular portion of baffle 118 and the annular flow path between suction feed pipe 116 and axially extending portion 118-2 whereas there is no physical barrier between holes 18-1 and open end 16-2.

In operation, the running of high side hermetic compressor 100 will draw refrigerant from the evaporator of a refrigeration system (not illustrated) into accumulator 110 with the flow serially passing through inlet pipe 114 into upper portion 112-3 of housing 112, through annular screen 120 and holes 118-1 in baffle 118 into lower portion 112-4 of housing 112. The flow through holes 118-1 must make a 180° turn to pass through the annular, axially extending space 130 between the outer portion of suction feed pipe 116 and the inner surface of axially extending portion 118-2, making a first fluid separation, before encountering the inner surface of the closed end of portion 118-2 requiring a 180° turn to enter open end 116-2 of suction feed pipe 116 and providing a second fluid separation. Flow through suction feed pipe 116 passes through suction inlet 100-1 into compressor 100 and is compressed. If there is any liquid refrigerant and/or oil 180 in lower portion 112-4 at a level up to or above metering port 116-1, the flow through suction feed pipe 116 aspirates the liquid 180 into the flow being supplied to suction inlet 100-1 of compressor 100. Because so much of lower portion 112-4 is below metering port 116-1 and because accumulator 110 extends below suction inlet 100-1, there is a residual volume 180 made up primarily of oil and constituting on the order of 30–35% of the volume of the total enlarged accumulator volume, i.e. 112-3 plus 112-4.

The operation of accumulator 110 can be under conditions of dry suction, wet suction, or on the continuum between these extremes as well as under the condition of liquid flood back.

If the suction flow is superheated to the extent to insure dryness of the suction vapor, practically no liquid-phase refrigerant accumulates in the accumulator 110. Thus, liquid below the metering port 116-1 is an oil-rich mixture or mainly consists of oil. In this case, the accumulator 110 in fact acts as an oil reservoir. Any shot of in-rush liquid refrigerant mixes with the oil 180 in the accumulator 110 prior to entering the compression chamber of compressor 100. The quality of the suction flow is relatively more oil-rich compared to that of the PRIOR ART accumulator 10 where no oil is pre-charged, i.e., an accumulator without an oil reservoir.

As suction superheat decreases, more liquid droplets are present in the stream and the quality of the suction becomes "wet" meaning a more refrigerant-rich flow.

Circulating oil is mixed in the vapor flow and the oil 180 in the accumulator 110 now mixes with more refrigerant. As this happens, the relatively small amount of liquid refrigerant mixes with oil 180 in the reservoir, making the suction quality more refrigerant rich compared to the case of dry suction described above. The liquid level of the oil 180 in the reservoir becomes more agitated.

As an another extreme condition, liquid-phase refrigerant can rush into the accumulator 110. The liquid-phase level of the oil 180 in the reservoir is raised and becomes further agitated and foamy. Though the quality of suction flow depends on the relative amount of the oil and liquid-refrigerant flow, it has better quality than in the case of the PRIOR ART accumulator 10 which does not contain oil in any significant quantity. The liquid refrigerant after being diluted with oil enters the compression chamber of compressor 100.

Although a preferred embodiment of the present invention has been described and illustrated, other modifications will occur to those skilled in the art. It is therefore intended that the present invention is to be limited only by the scope of the appended claims.

What is claimed is:

1. An accumulator comprising:

a housing having an interior defining a volume;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said means for withdrawing refrigerant including a pipe extending into said housing at an intermediate point of said lower portion and through at least a portion of said lower portion of said interior and having an upwardly extending open end located in said interior and a metering port in said pipe at a location in said lower portion such that 30% of said volume is at a level no higher than said metering port.

2. The accumulator of claim 1, wherein said pipe has an upper open end and wherein said upper open end is positioned above said at least one hole.

3. An accumulator comprising:

a housing having an interior defining a volume;

a baffle located in said interior and dividing said interior into an upper portion and a lower portion;

at lest one hole in said baffle providing fluid communication between said upper portion and said lower portion, wherein said baffle includes an annular portion with said at least one hole located therein, a cylindrical section extending both above and below said annular portion and having a closed end located above said annular portion;

means for supplying refrigerant to said upper portion;

means for withdrawing refrigerant from said lower portion and passing said withdrawn refrigerant from said housing;

said means for withdrawing refrigerant including a pipe extending into said housing at an intermediate point of said lower portion and though at least a portion of said lower portion of said interior and having an upwardly extending open end located in said interior and a metering port in said pipe at a location in said lower portion such that 30% of said volume is at a level no higher than said metering port.

4. The accumulator of claim 3 wherein said pipe extends into said cylindrical section and is spaced therefrom to define an annular flow path and said closed end of said baffle is spaced from said open end of said pipe whereby flow through said annular flow path must turn 180° to enter said open end.

5. An accumulator comprising:

a housing having an interior defining a volume;

a baffle located in said interior and dividing said interior into an upper portion and a lower portion;

at least one hole in said baffle providing fluid communication between said upper portion and said lower portion wherein said at least one hole is overlain by an annular screen;

means for supplying refrigerant to said upper portion;

means for withdrawing refrigerant from said lower portion and passing said withdrawn refrigerant from said housing;

said means for withdrawing refrigerant including a pipe extending into said housing at an intermediate point of said lower portion and through at least a portion of said lower portion of said interior and having an upwardly extending open end located in said interior and a metering port in said pipe at a location in said lower portion such that 30% of said volume is at a level no higher than said metering port.

6. A hermetic compressor having an accumulator secured thereto, said accumulator comprising:

a housing having an interior defining a volume;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said means for withdrawing refrigerant including a pipe extending into said housing at an intermediate point of said lower portion and through at least a portion of said lower portion of said interior and having an upwardly extending open end located in said interior and a metering port in said pipe at a location in said lower portion such that 30% of said volume is at a level no higher than said metering port; and said means for withdrawing fluidly connected to said compressor for supplying refrigerant thereto and said intermediate point corresponds to the location at which said means for withdrawing refrigerant is fluidly connected to said compressor.

* * * * *